US008220517B2

(12) United States Patent
Kollman et al.

(10) Patent No.: US 8,220,517 B2
(45) Date of Patent: Jul. 17, 2012

(54) BREAKAWAY CORD SYSTEM FOR WOVEN WOOD AND ROMAN SHADES

(75) Inventors: Michael Kollman, Fitchburgh, WI (US); Nicholas J. Schultz, Marshall, WI (US); Fredrik M. Dominy, Madison, WI (US)

(73) Assignee: Lumino, Inc., Madison, WI (US)

( * ) Notice: Subject to any disclaimer, the term of this patent is extended or adjusted under 35 U.S.C. 154(b) by 190 days.

(21) Appl. No.: 12/569,338

(22) Filed: Sep. 29, 2009

(65) Prior Publication Data

US 2011/0073260 A1 Mar. 31, 2011

(51) Int. Cl.
*A47H 3/00* (2006.01)

(52) U.S. Cl. ..... 160/84.01; 24/115 F

(58) Field of Classification Search ..... 160/84.01, 160/84.04, 178.1 R, 173 R, 176.1 R, 168.1 R; 24/115 F, 602, 667; 403/289, 290, 325, 327
See application file for complete search history.

(56) References Cited

U.S. PATENT DOCUMENTS

| | | | | |
|---|---|---|---|---|
| 3,777,800 | A * | 12/1973 | Susoev | 160/84.04 |
| 5,451,445 | A * | 9/1995 | Wang | 428/131 |
| 5,548,879 | A * | 8/1996 | Wu | 24/625 |
| 6,431,248 | B1 | 8/2002 | Hyman et al. | |
| 6,591,461 | B2 * | 7/2003 | Salentine et al. | 24/115 F |
| 6,817,399 | B2 * | 11/2004 | Berman et al. | 160/84.04 |
| 6,837,645 | B2 * | 1/2005 | Kanatani et al. | 403/348 |
| 6,845,803 | B1 * | 1/2005 | Nien | 160/178.1 R |
| 7,017,230 | B2 * | 3/2006 | Lin | 16/202 |
| 7,086,446 | B2 | 8/2006 | Kollman et al. | |
| 7,318,251 | B2 * | 1/2008 | Lin | 16/202 |
| 7,510,345 | B2 * | 3/2009 | Kosh et al. | 403/330 |
| 7,703,500 | B2 * | 4/2010 | Wen et al. | 160/84.05 |
| 7,938,161 | B2 * | 5/2011 | Lin | 160/84.01 |
| 2003/0150567 | A1 | 8/2003 | Hyman et al. | |
| 2005/0207837 | A1 * | 9/2005 | Kosh et al. | 403/327 |
| 2006/0144526 | A1 | 7/2006 | McGinley | |
| 2007/0023149 | A1 * | 2/2007 | Lamars et al. | 160/84.01 |
| 2010/0126673 | A1 * | 5/2010 | Lin | 160/84.01 |
| 2010/0126674 | A1 * | 5/2010 | Lin | 160/84.03 |
| 2010/0126677 | A1 * | 5/2010 | Lin | 160/340 |
| 2010/0126679 | A1 * | 5/2010 | Lin | 160/370 |
| 2010/0307699 | A1 * | 12/2010 | Chen | 160/127 |
| 2011/0048652 | A1 * | 3/2011 | Chen | 160/84.04 |
| 2011/0108216 | A1 * | 5/2011 | Levin | 160/340 |
| 2011/0108217 | A1 * | 5/2011 | Levin | 160/340 |
| 2011/0192549 | A1 * | 8/2011 | Wen et al. | 160/84.04 |

* cited by examiner

*Primary Examiner* — Blair M Johnson
*Assistant Examiner* — Jaime F Cardenas-Garcia
(74) *Attorney, Agent, or Firm* — Buchanan Ingersoll & Rooney PC

(57) ABSTRACT

In a breakaway device for a Roman shade a male member has an aperture through which the lift cord passes and a female member through which the lift cord passes, such that the male member and the female member are independently moveable relative to the lift cord. The female member has a cavity sized and configured to receive the male member. Tabs extend from the male member and fit into slots in the female member when the male member is in the cavity. A downward and outward force on the lift cord causes the male member and the female member to separate from one another. An upward force or a downward force on the lift cords will not cause separation.

16 Claims, 8 Drawing Sheets

BREAKAWAY CORD SYSTEM FOR WOVEN WOOD AND ROMAN SHADES

FIELD OF INVENTION

The present invention relates to a child safety device for window blinds, particularly woven wood shades and Roman shades and shades having such child safety devices.

BACKGROUND OF THE INVENTION

In recent years there has been much concern in the window covering industry about child safety. Within the past two years there have been instances involving roman shades in which a child's head and neck have become entangled in one of the lift cords that extends down the back face of the shade. As a result of one such instance the United Stares Consumer Product Safety Commission required the importer to recall the Roman shade from the marketplace. Representatives from window covering manufacturers have met with staff members from the United Stares Consumer Product Safety Commission to discuss ways to prevent children from being strangled by the cord used in window covering products. Some of these discussions have focused on the development of breakaway devices that could be used to connect the cords to the window covering material. The goal is that the device would release the cord from the window covering if a child became entangled in the cord.

The art has developed breakaway devices for window covering products. One such device for roll-up shades is disclosed in U.S. Pat. No. 7,086,446 issued to Kollman et al. This breakaway device has a U-shaped clip to which a lift cord is permanently attached. The U-shaped clip can be attached to one of three sections of a safety rail. The safety rail is permanently attached to the headrail of the shade. The first two sections of the safety rail are flat and have a bead along the lower edge. The clip fits over the bead and, depending upon the bead size in the selected section, will release upon application of a predetermined force, such as four pounds or ten pounds. The third section has a scored portion that can be removed to create a hole through which the U-shaped clip can be fitted so that the cord will not breakaway from the safety rail. In order to connect the clip to the third portion of the safety rail, the user must punch out the second portion of the rail to provide an opening through which the clip is inserted. While this device works well for roll-up shades, it is not suitable for use on a Roman shade.

Hyman et al. a disclose breakaway cord connection apparatus for roll-up shades in U.S. Pat. No. 6,431,248 and published U.S. patent application No. 2003/0150567 A1. Both references disclose a releasable cord connection apparatus in which the cord is attached to a V-shaped connective member. That connective member is inserted into a recess provided in a receptive member attached to the headrail. When a sufficient force is applied to the cord connected to a connective member, the top of the V-shaped body collapses, allowing the connective member to pass through the recess releasing the connective member and cord from the receptive member, The published application also discloses a breakaway apparatus in which a breakaway end portion on a cord can move along a recessed track and separate from the track when a downward force is applied to the cord. This breakaway device is also not suitable for use on a Roman shade.

Roman shades and woven wood shades such as shade 1 shown in FIG. 1 have lift cords 2 that extend from a headrail 3 through a series of spaced apart rings 4 provided down the back face of the window covering material 5. In a Roman shade the window covering material is a woven or non-woven fabric. In a woven wood shade the window covering material is wood sticks, faux wood sticks or grasses woven together to form a panel. The end of each lift cord is attached to the window covering material at or near the bottom 6 of the shade. It is possible that a standing loop can be formed by the lift cord between any pair of adjacent rings such that a child's head can become entangled in the loop. The Window Covering Manufacturer's Association has sponsored a standard for safety of corded window covering products which bears number ANSI/WCMA A100.1-2009 (PS). The standard provides that a manufacturer of a Roman shade or woven wood shade can meet the safety standard in several ways. One option is to make the shade so that the cords are not accessible. This can be done by adding a cover layer of fabric over the back of the shade. But, that layer increases the costs of the shade and changes the appearance of the shade. Another option to satisfy the WCMA safety requirement is to place the attachment rings on the back of the shade no more than 8 inches apart, rather than about 15 inches apart as in most Roman shades that have been sold in the past, thereby not allowing a child's head or neck to fit through this opening. However, this manufacturing change results in more labor and cost to install additional attachment rings and the products stack depth doubles making this product a poor option for narrow window depths. In addition, it changes the atheistic which may not be liked by the consumer. A third way to meet the standard is to provide a breakaway device on the shade that passes the test set forth in the standard. The standard requires the device to break away from the shade when three pounds of force is exerted on the lift cord in a downward direction while the shade is in a fully extended position. The device used for the test is designed to simulate a child's head and neck.

The industry has struggled to develop a breakaway device that will release when a three pound downward force is exerted on the lift cord, but still be strong enough to lift the shade. There are many differ stock sizes and shade materials so the weight of each different shade can vary greatly. Also different sizes have a different number of lift cords spreading the shades weight out in different ratios. One could accomplish a low breakaway force by adding more cords, but this makes the shade harder to operate and adds costs to the product. Another concern is how quickly the consumer raises and lowers the shade which will affect the forces applied on the breakaway device. If a consumer drops the shade quickly the device might breakaway easier becoming a nuisance for the consumer and could result in a product return.

Consequently, there is an unsatisfied need for a child safety breakaway device for window coverings that will meet the three pound test standard and not breakaway during normal use when the blind is being raised and lowered by the user.

SUMMARY OF THE INVENTION

We provide a woven wood shade or Roman shade having a breakaway device that meets the three pound separation test of the Window Covering Manufacturer's Association and does not breakaway during normal use. The shade has breakaway devices disclosed herein that are attached between the lift cords and the window covering material. We prefer to use these breakaway devices in place of the rings and other connectors that have been used to connect the lift cords to the shade material.

We prefer to provide a breakaway device that has a male member and a female member. The breakaway device can be configured so that either the female member or the male member is attached to the window covering material. The male member has an aperture through which the lift cord passes such that the lift cord and the male member are independently moveable relative to one another. The female member also has an opening through which the lift cord passes, such that the lift cord and the female member are independently moveable relative to one another. The female member has a cavity sized and configured to receive the male member. The lift cord passes through the apertures in the male member and the female member. A pair of legs extends from the male member. Each leg has a tab that extends outward from the leg and fits into a mating slot in the female member. A stop or knot is provided at the distal end of each lift cord that prevents the end of the lift cord from passing through the breakaway device. Upward movement of the lift cord causes the breakaway devices at the bottom of the shade to move upward, raising the window covering material from an extended position toward a retracted position. Movement of the lift cord in a downward and outward direction without a corresponding downward movement of the window covering material will cause the male member and the female member to separate from one another.

Other objects and advantages of our shade with breakaway device will become apparent from a description of certain present preferred embodiments thereof shown in the drawings.

DESCRIPTION OF THE PREFERRED EMBODIMENTS

Figure 1:
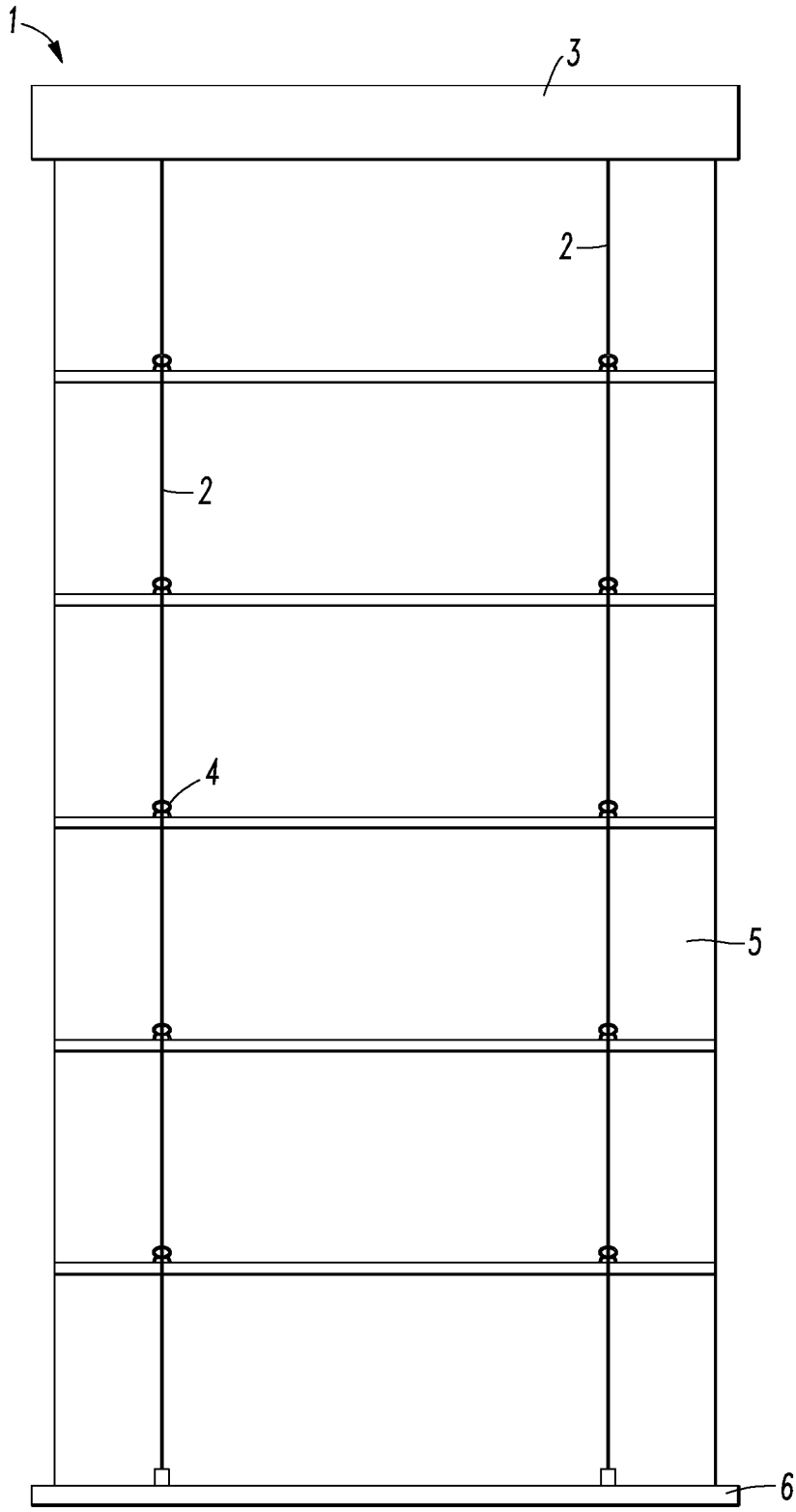
FIG. 1 PRIOR ART
FIG. 1 is a rear view of a Roman shade of the type known in the art.
Figure 2:
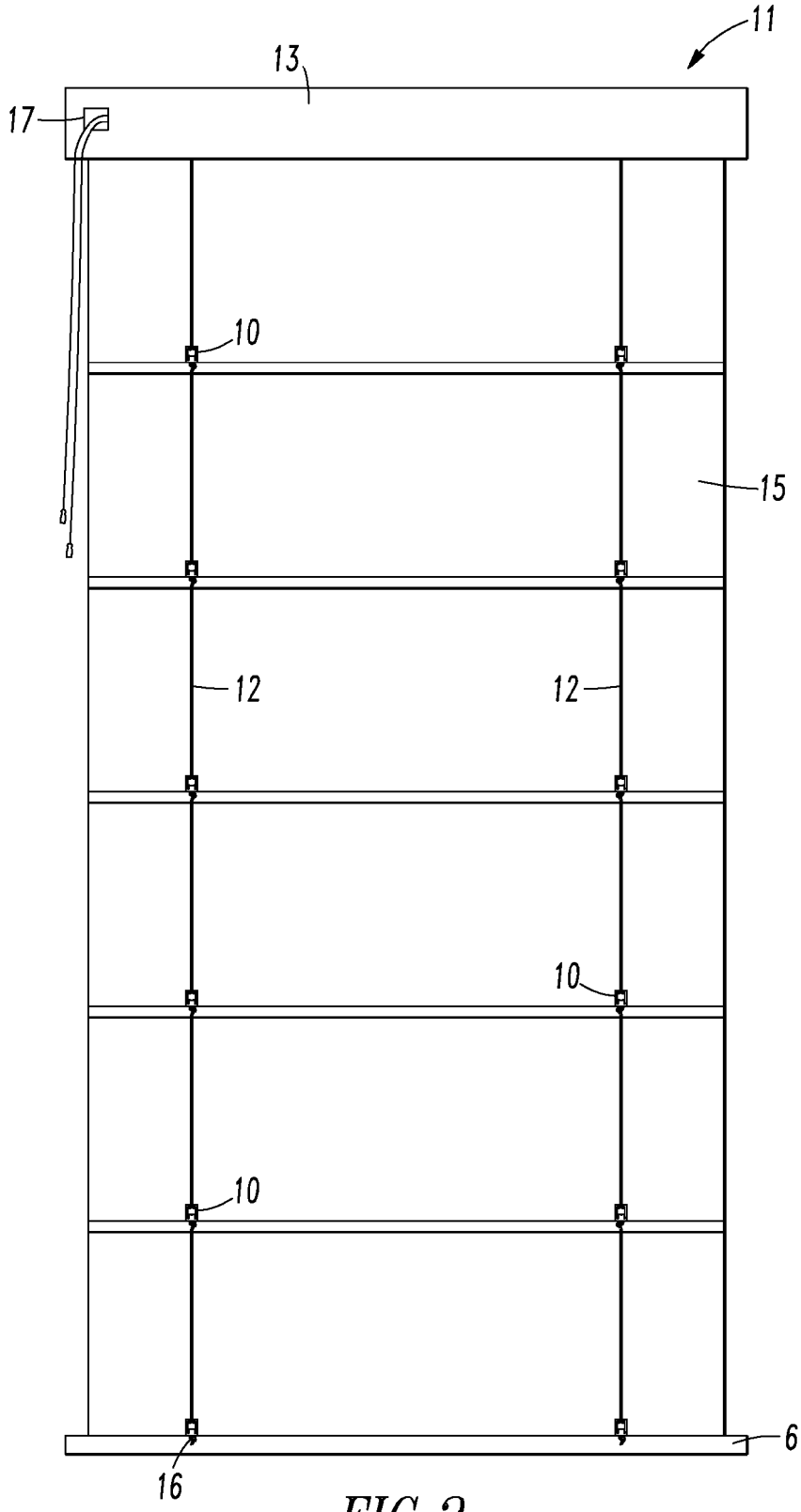
FIG. 2 is a rear view of a Roman shade or woven wood shade having our breakaway devices.

A roman shade or woven wood shade 11 with a first present preferred embodiment of our breakaway device 10 is shown in FIG. 2. This shade has a headrail 13, bottomrail 6 and window covering material such as a woven wood extending between the headrail 13 and bottomrail 14. Lift cords 12 pass through a cord lock 17 in the headrail along the back face of the window covering material to the bottom of the shade. One could use a lift mechanism other than a cord lock, such as a spring motor, to control the lift cords. Breakaway devices 10 are provided on the shade in place of the rings 4 in the prior art shade. The lift cord 12 passes through an opening 36 in the male member 30 of the breakaway device 10, 40, 60 shown in FIGS. 3 through 10. As shown in FIG. 2, a knot 16 is provided at the distal end of each lift in the cord which acts as a stop. If the cord 12 is pulled upward, the knot will engage the male member or female member depending upon the embodiment moving the breakaway device 10 and bottom of the shade upward. A ball or plug could be attached to the cord in place of the knot to act as a stop.

Figure 3:
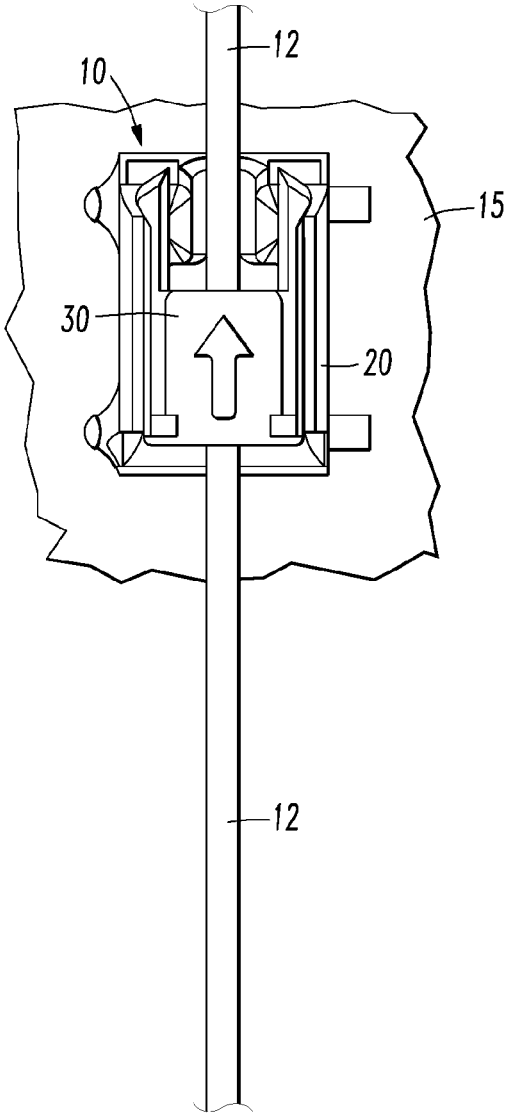
FIG. 3 is and front view of a first present preferred embodiment of our breakaway device attached to a portion of a Roman shade or woven wood shade.
Figure 4:
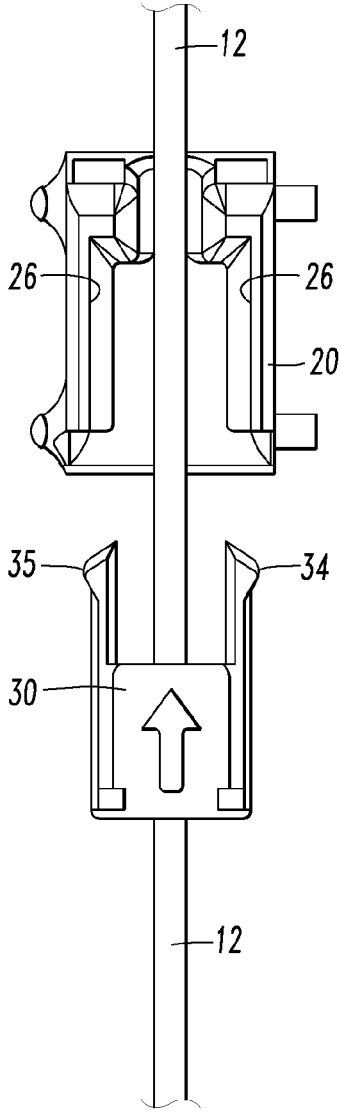
FIG. 4 is a front view similar to FIG. 4 showing our breakaway device after the male member had separated from the female member.
Figure 5:
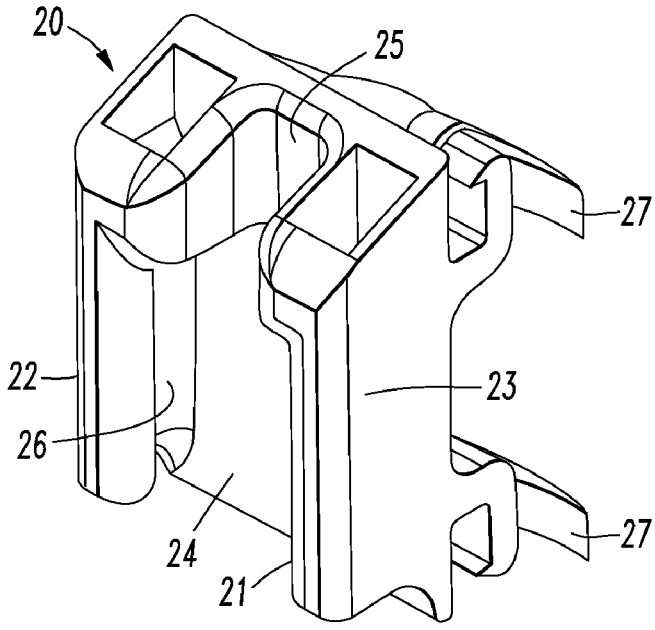
FIG. 5 is a perspective view of the female member in the first present preferred embodiment of our breakaway device shown in FIGS. 3 and 4.
Figure 6:
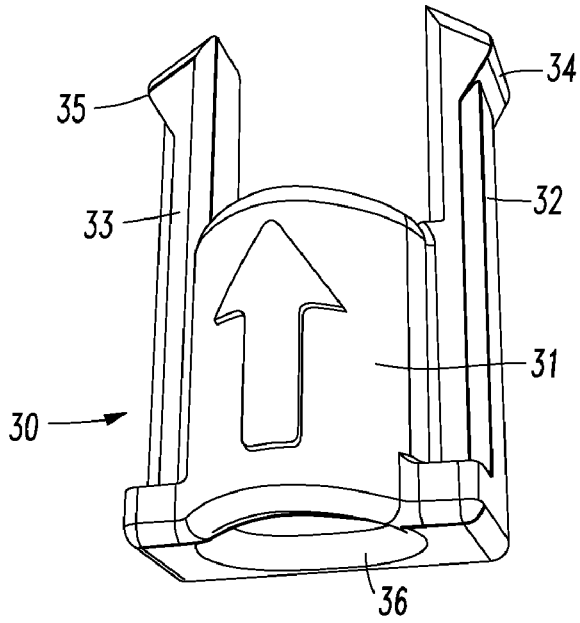
FIG. 6 is a perspective view of the male member in the first present preferred embodiment of our breakaway device shown in FIGS. 3 and 4.
Figure 7:
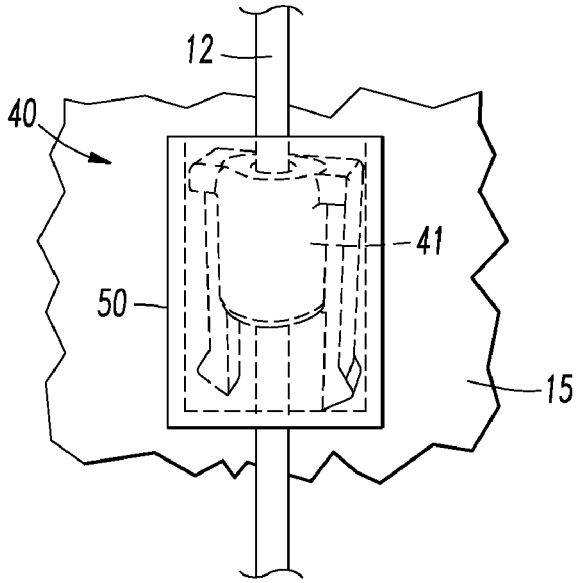
FIG. 7 is a front view of a second present preferred embodiment of our breakaway device attached to a portion of a Roman shade or woven wood shade.

As shown most clearly in FIGS. 3-6, the first present preferred embodiment of our breakaway device 10 has a female member 20 and a male member 30. The female member 20 is attached to the window covering material 15 by prongs 27 or other connection that extends from housing 21 as shown in FIG. 5. We prefer to provide two or more prongs 27 so that the female member may not twist or rotate relative to the window covering material or the lift cord. Attaching the device at two different points on the shade also prevents it from tilting up and allowing the male member and female member to separate from one another.

Two parallel sides 22 and 23 define a cavity 24 sized to receive the male member 30. An aperture 25, preferably is a slot, is provided at the top of the female member so that a lift cord 12 can pass through the opening. This can be seen in FIGS. 3 and 4.

We provide legs 32 and 33 that extend from the housing 31 of the male member. Each leg has an outwardly extending tab 34, 35. When the male member is within the female member as shown in FIG. 3, tabs 34 and 35 will engage slots 26 on sides 22 and 23. Downward and outward movement of the cord 12, as would occur if a child becomes entangled in the lift cord, causes the male member to separate from the female member as shown in FIG. 4. Upward movement and only downward movement of the lift cords will not cause separation.

Figure 8:
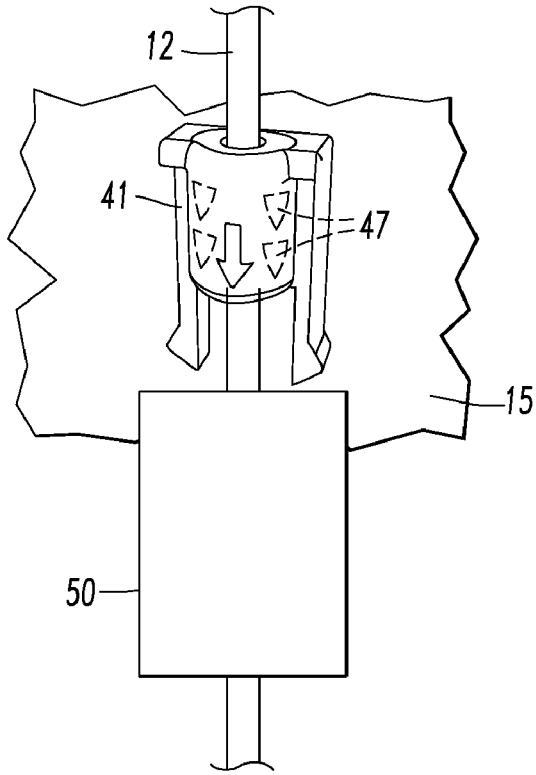
FIG. 8 is a rear view of the breakaway device shown in FIG. 7 after the female member had separated from the male member.
Figure 9:
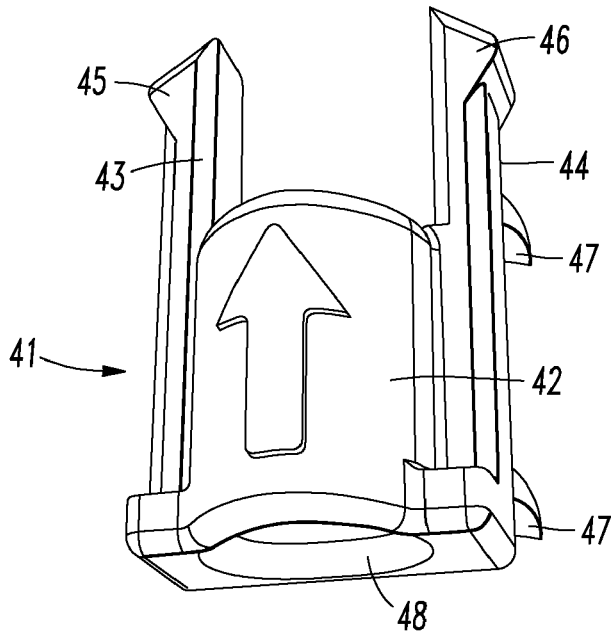
FIG. 9 is a perspective view of the female member in the a second present preferred embodiment of our breakaway device shown in FIGS. 7 and 8.
Figure 10:
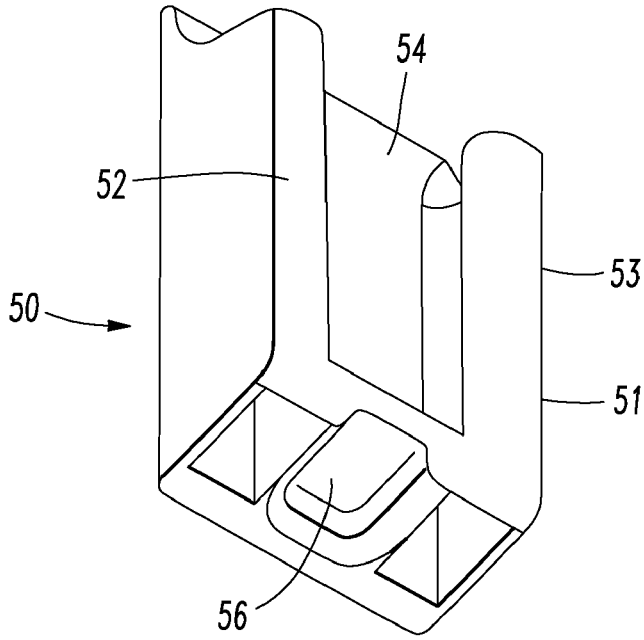
FIG. 10 is a perspective view of the male member in the a second present preferred embodiment of our breakaway device shown in FIGS. 7 and 8.

A second present preferred embodiment of our breakaway device 40 is shown in FIGS. 7, 8, 9 and 10. In this embodiment, the male member 41 is attached to the window covering material 15. As can be seen in FIGS. 7-10, the male member 41 and female member 50 are similar in construction to male member 30 and female member 20 in the first embodiment. The male member 41 has a cylindrical housing 42 having an opening 48 through which the lift cord passes. Legs 43 and 44 extend from the housing. Outwardly extending tabs 45 and 46 are provided on each leg. In this embodiment prongs 47 extend from the male member and are used to attach the male member to the window covering material. The female member 50 has a housing 51 containing two parallel sides 52 and 53. The sides define a cavity 54 which is sized to receive the male member 41. An aperture 56, preferably a hole rather than a slot, is provided in the female member. The opening is sized to permit the lift cord 12 to pass through the aperture. This embodiment functions in much the same way as the first embodiment. Downward and outward force on the lift cord causes the female member 50 to separate from the male member 41 as shown in FIG. 8. Upward movement and only downward movement of the lift cord will not cause separation.

In our testing the first present preferred embodiment we found that if the consumer drops the shade quickly the device can breakaway on its own. Therefore, we provide a third present preferred embodiment shown in FIGS. 11 and 12 which has a clip that can be removably attached to the device preventing the device from breaking away. This way if a customer does not have the need for a breakaway device because the customer does not have small children in his or her home, the customer can attach this plastic piece to defeat the breakaway.

Figure 11:
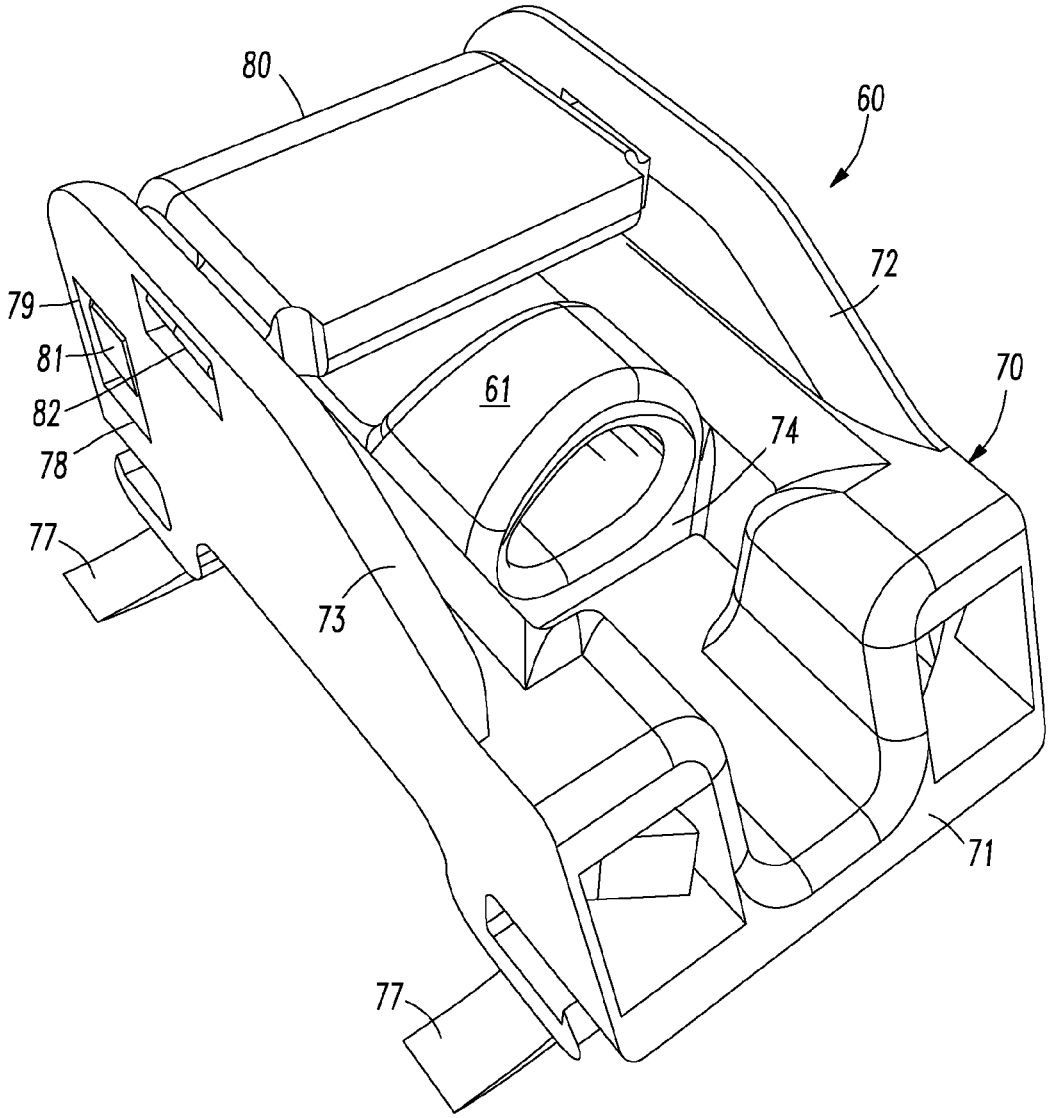
FIG. 11 is a perspective view of a third present preferred embodiment of our breakaway device in an assembled condition.
Figure 12:
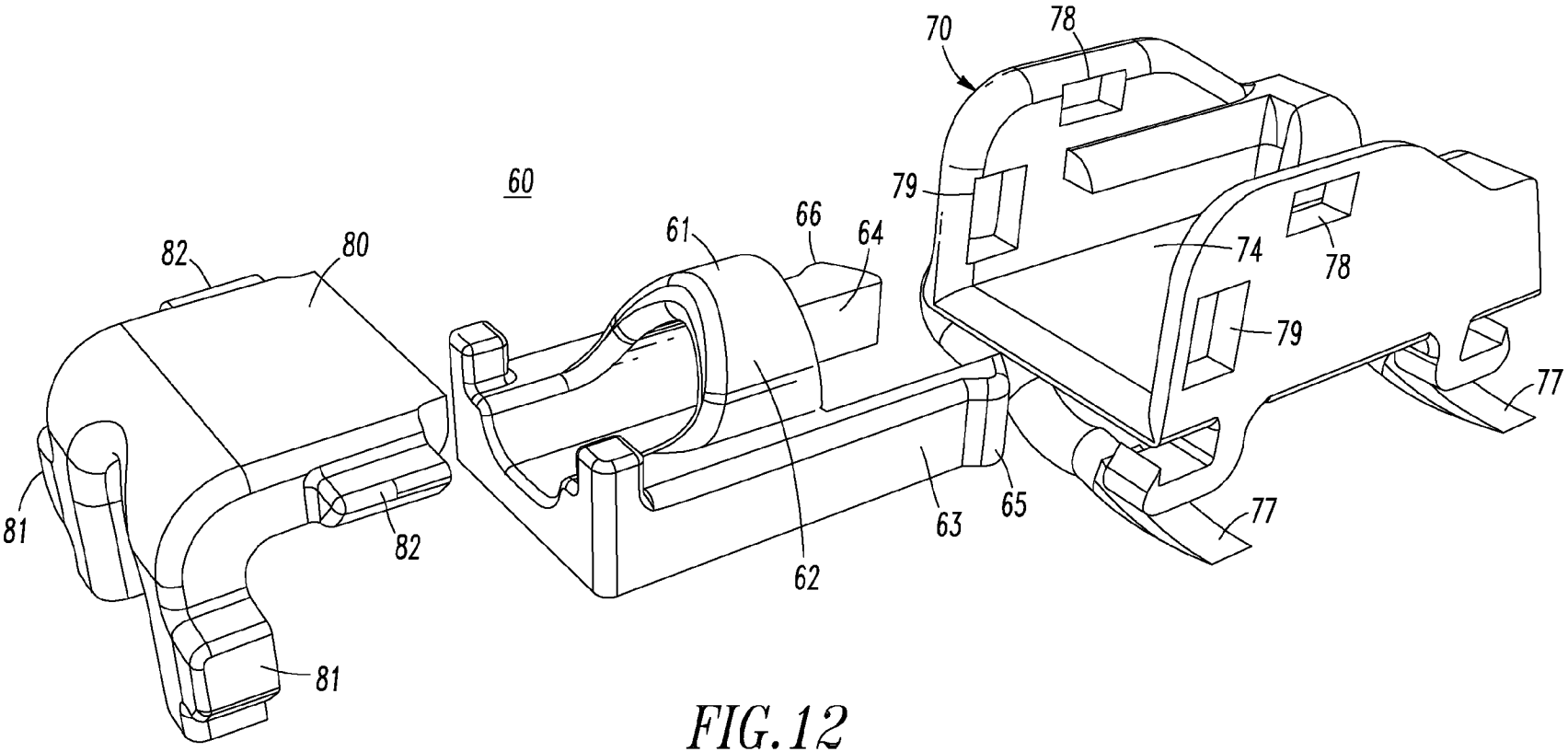
FIG. 12 is an exploded view of the third present preferred embodiment shown in FIG. 11.

The third present preferred embodiment of our breakaway device 60 shown in FIGS. 11 and 12 has a male member 61 and female member 70 that are similar in construction to the male member and the female member in the first embodiment. The male member 60 has a cylindrical housing 62, legs 63 and 64 extend from the housing. Outwardly extending tabs 65 and 66 are provided on each leg that engage the female member 70. The female member 70 has a housing 71 containing two parallel sides 72 and 73 that define a cavity 74 which is sized to receive the male member 61. Prongs 77 extend from the female member and are used to attach the female member to the window covering material. An L-shaped clip 80 fits over the male member when the male member is in the cavity 74 of the female member. Tabs 81 and 82 extend from opposite sides of the clip and fit into slots 78 and 79 in the female member. When the clip is attached to the female member in this way the clip prevents separation of the male member from the female member. When the clip is removed this embodiment functions in much the same way as the first embodiment.

We prefer to make the male member 30, 60 to have a length shorter than the length of the cavity 24, 74 in the female member 20, 70. The lengths are such that should the blind be positioned such that two breakaway devices abut one another, the male member can still move within the cavity and breakaway when a downward and outward force is applied.

In all of the embodiments, neither the female member nor the male member is affixed to the lift cord at any point. Thus, both the female member and the male member can move independently relative to the lift cord and relative to one another.

The male member and female member can be made of plastic, such as polyoxymethylene. Preferably the female member has a length of about one-half inch, a width of about three eighths of an inch and a depth of about a quarter inch. The male member preferably has a length about three eighths of an inch and a diameter of about one eighth inch.

Our breakaway device is designed to breakaway only when forces act on the lift cord in a downward and outward direction and not while the shade is being raised. Our device takes very little force in the downward and outward direction to cause separation (three pounds and even as little as 1.5 to two pounds in our tests and it could even be less if needed). But purely upward force and purely downward force on the lift cords, as occurs when the shade is raised and lowered, will not cause separation.

The present breakaway device will separate in the three pound test of the WCMA standard for corded window covering products. However, the breakaway device will not separate when an upward force is applied to lift the shade. With the present design, there are no inadvertent separations of the male member from the female member in our breakaway device.

Although we have described certain present preferred embodiments of our window covering product with breakaway device, it should be distinctly understood that the invention is not limited thereto but may be variously embodied within the scope of the following claims.

We claim:

1. A window covering comprising:

a first rail;

window covering material extending from the first rail, the window covering moveable from a retracted position to extended positions;

a plurality of lift cords, each lift cord extending from the first rail along a face of the window covering material and having a distal end;

at least one breakaway device for each lift cord, the lift cord passing through the at least one breakaway device, the breakaway device attached to the window covering material and comprising:

a male member having an aperture through which the lift cord passes such that the lift cord and the male member are independently moveable relative to one another when the window covering is in use, and a female member having an opening through which the lift cord passes, such that the lift cord and the female member are independently moveable relative to one another when the window covering is in use, the female member having a cavity sized and configured to receive and releasably retain the male member when the male member is in the cavity, such that when the male member is within the cavity a downward and outward force acting on the lift cord will cause the male member and the female member to separate from one another; and a stop attached to the distal end of each lift cord such that upward movement of the lift cord will cause the stop to engage one of the at least one breakaway device and move upward, raising the window covering material from an extended position toward a retracted position.

2. The window covering of claim 1 wherein the male member also comprises a pair of outwardly extending tabs and the female member has a pair of slots sized and configured to receive the tabs when the male member is releasably retained by the female member.

3. The window covering of claim 1 wherein the stop is a knot formed in the lift cord.

4. The window covering of claim 1 the female member also comprising a pair of prongs attaching the female member to the window covering material.

5. The window covering of claim 1 the male member also comprising a pair of prongs attaching the male member to the window covering material.

6. The window covering of claim 1 also comprising a bottom rail attached to the window covering material and to which at least one of the at least one breakaway device is attached.

7. The window covering of claim 1 wherein the first rail is a headrail and the window covering material is a composed of fabric, woven wood or woven grass.

8. The window covering of claim 1 wherein the window covering is a roman shade.

9. The window covering of claim 1 further comprising a lift mechanism attached to the first rail and to which the plurality of lift cords are connected.

10. The window covering of claim 1 wherein the at least one breakaway device for each lift cord is comprised of a plurality breakaway devices for each lift cord.

11. The window covering of claim 1 comprising a cord lock attached to the first rail, the plurality of lift cords passing through the cord lock.

12. The window covering of claim 1 wherein the male member and female member of the breakaway device are sized and configured such that a downward and outward force of at least three pounds on the lift cord through the breakaway device is required to cause the male member and female member to separate from one another.

13. The window covering of claim 1 wherein the at least one breakaway device is comprised of polyoxymethylene.

14. The window covering of claim 1 wherein the male member is within the cavity of the female member and further comprising a clip removably attached to the female member and fitting over the male member such that the male member will not separate from the female member.

15. The window covering of claim 14 wherein the clip is comprised of a plurality of tabs and the female member has a slot for each tab positioned so that the tabs are in the slots when the clip is removably attached to the female member.

16. The window covering of claim 1 wherein the male member has a length less than a length of the cavity of the female member.

* * * * *